US008684851B2

(12) United States Patent
Slack

(10) Patent No.: US 8,684,851 B2
(45) Date of Patent: Apr. 1, 2014

(54) FLOATING SUB TOOL

(75) Inventor: Maurice William Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 0 days.

(21) Appl. No.: 13/818,961

(22) PCT Filed: Sep. 2, 2011

(86) PCT No.: PCT/CA2011/001004

§ 371 (c)(1),
(2), (4) Date: Feb. 25, 2013

(87) PCT Pub. No.: WO2012/027838

PCT Pub. Date: Mar. 8, 2012

(65) Prior Publication Data

US 2013/0157767 A1 Jun. 20, 2013

Related U.S. Application Data

(60) Provisional application No. 61/380,027, filed on Sep. 3, 2010.

(51) Int. Cl.
*E21B 17/02* (2006.01)

(52) U.S. Cl.
USPC ..... 464/163

(58) Field of Classification Search
USPC ..... 464/18, 20, 163; 175/321; 166/242.7
See application file for complete search history.

(56) References Cited

U.S. PATENT DOCUMENTS 3,667,252 A * 6/1972 Nelson ..... 464/20
4,055,338 A 10/1977 Dyer
4,145,034 A * 3/1979 Dyer ..... 175/321 X
4,192,155 A 3/1980 Gray
4,759,738 A 7/1988 Johnson (Continued)

FOREIGN PATENT DOCUMENTS

WO WO 2006/116870 A1 11/2006

OTHER PUBLICATIONS

International Preliminary Report on Patentability (IPRP-I) issued Mar. 5, 2013 by the International Bureau of WIPO, and incorporating Written Opinion of the International Searching Authority (CIPO) dated Dec. 14, 2011 re PCT/CA2011/001004.

*Primary Examiner* — Gregory Binda
(74) *Attorney, Agent, or Firm* — Donald V. Tomkins

(57) ABSTRACT

An axially-floating sub tool for axial load compensation in conjunction with a top drive comprises cylindrical upper and lower members, with the upper member being coaxially disposed within a cylindrical housing. The upper member has an upper section slidably disposed within an opening in the upper end of the housing, plus a middle section that slidably and sealingly engages the housing bore. The lower-member bore has a splined upper interval, and a coaxial stinger extending upward from an annular shoulder medially located in the lower-member bore. The lower member is connected to the lower end of the housing with the stinger slidingly and sealingly disposed within the upper-member bore, and with the lower-member splines slidingly engaging the upper-member splines, thus defining upper, middle, and lower annular chambers, with the middle and lower chambers in fluid communication, and with a regulator/check valve regulating pressure in the middle and lower chambers.

10 Claims, 7 Drawing Sheets

(56) References Cited

U.S. PATENT DOCUMENTS

| | | | |
|---|---|---|---|
| 4,844,181 | A | 7/1989 | Bassinger |
| 5,224,898 | A | 7/1993 | Johnson et al. |
| 5,660,241 | A | 8/1997 | Leising et al. |
| 6,332,841 | B1 | 12/2001 | Secord |
| 7,325,610 | B2 | 2/2008 | Giroux et al. |
| 7,909,120 | B2 | 3/2011 | Slack |

* cited by examiner

FLOATING SUB TOOL

FIELD OF THE DISCLOSURE

The present disclosure relates in general to drill string components used to transmit rotary power and carry axial loads in top-drive-equipped drill rigs, and in particular to drill string components used in casing-running or casing-drilling operations for wells bored into subsurface formations.

BACKGROUND

Wells for production of hydrocarbon fluids such as oil and natural gas are typically drilled by connecting a drill bit to the lower end of a drill string made up of sections (or "joints") of drill pipe connected end-to-end by means of threaded connections, and then rotating the drill bit into the ground until the bit penetrates a hydrocarbon-producing subsurface formation. After the well has been drilled, it is typically necessary to line the wellbore with tubular casing to prevent soil materials from sloughing into the wellbore and thus partially or completely collapsing the wellbore. Accordingly, after the drill string as been withdrawn from the drilled wellbore, a casing string is installed in the wellbore. The casing string is made up of pipe sections having a diameter larger than the drill pipe, and slightly smaller than the wellbore, and the resultant annular space between the casing and the wellbore is filled with a cement slurry. The process of installing casing in a drilled wellbore is commonly referred to as "casing running".

Although it has in the past been most common for wells to be drilled using the drilling and casing procedures described above, it has become increasingly common for wells to be drilled using casing as the drill string, with the drill bit connected to the lower end of the casing string (a procedure commonly referred to as "casing drilling" or "drilling with casing"). When the wellbore reaches the target formation, the casing string is simply cemented into place. This procedure necessitates leaving the drill bit underground, but the cost of the drill bit is outweighed by savings in both time and money by not needing to use a separate drill string and withdraw it from the wellbore, and then running casing into the wellbore in a separate operation.

When drilling a wellbore using a top-drive-equipped drilling rig, it is well known to include a device known as a "floating cushion sub" at the upper end of the drill string, i.e., near the top drive quill. (The term "sub" is commonly used in the oil and gas industry with reference to any small or secondary drill string component.) Floating cushions subs are capable of transmitting torque through a limited axial stroke range (which is why they are referred to as "floating"). At one or both ends of the axial stroke range, a floating cushion sub provides axial load transfer (compression or hoist load) through a compliant element (typically an elastomeric element) that acts as a "cushion". Together with frictional drag, this cushion tends to damp the transmission of drilling vibrations initiated at the drill bit that would otherwise be transmitted upward into the top drive and rig structure, which is not a desirable condition.

Examples of known floating cushion subs may be seen in U.S. Pat. No. 4,055,338 (Dyer); U.S. Pat. No. 4,192,155 (Gray); U.S. Pat. No. 4,759,738 (Johnson); U.S. Pat. No. 4,844,181 (Bassinger); U.S. Pat. No. 5,224,898 (Johnson et al.); and U.S. Pat. No. 6,332,841 (Secord).

One of the routine procedures carried out during well drilling operations is the connection of a new segment (or "joint") of drill pipe to the drill string, by threading the new pipe joint into the upper end of the drill string. This connection procedure is commonly referred to as "making up" a connection, while the reverse procedure is referred to as "breaking out" the connection. Typically, the upper end of each joint of pipe in the drill string carries a female thread and is referred to as a "box end", while the lower end of each joint carries a male thread and is referred to as a "pin end".

When drilling using a top-drive-equipped drilling rig, connection make-up requires a reduction in the vertical distance between the top drive and the already-assembled drill string (which is suspended from the rig floor), as the new pipe joint (suspended from the top drive) is being threaded into the drill string. If the vertical position of the top drive is not adjusted during make-up, this axial movement tends to induce axial tensile loading in the drill string as a function of the prevailing system stiffness. This axial tension must be resisted at the thread interface during relative rotation of the pin end and box end threads of the connection being made up. This axial tension across the thread interface tends to increase thread wear and can lead to thread damage such as galling.

Breaking out a threaded connection has the reverse effect; i.e., there needs to be an increase in the vertical distance between the top drive and the upper end of the drill string from which a pipe joint is being removed, to prevent the development of compression across the thread interface.

By providing a range of free axial stroke (or float), a floating cushion sub can be interposed between the top drive and the pipe joint being added or removed, to effectively provide the vertical reduction or increase required for connection make-up or break-out, thereby making it unnecessary to adjust the vertical position of the top drive. However, this still typically results in the weight of at least one joint of pipe being carried by threads.

Top drive rigs are now being used not only to assemble drill strings, but also to assemble casing strings and production tubing strings, and the pipe most commonly used for casing and production tubing have less robust threads than typical drill pipe. Accordingly, there is an increased need for means to better manage the axial loads induced during make-up and break-out operations using top drives, particularly in the context of casing and tubing strings. Simply pressing a known type of floating cushion sub into new service is not always possible or optimally effective, due to limitations in hoisting capacity of the sub, due to the axial load needing to be further reduced to avoid thread damage, and/or due to the need or desire to expedite make-up and break-out by not requiring the vertical position of the top drive to be adjusted as frequently or with as much precision as might otherwise be required. Furthermore, axial float may provide similar advantages for use with casing running tools the length of which changes during normal operation; see, for example, the "Gripping Tool" disclosed in U.S. Pat. No. 7,909,120.

BRIEF SUMMARY OF THE DISCLOSURE

The present disclosure teaches embodiments of a floating sub tool providing axial load compensation through an axial stroke range by means of positive pressure or vacuum. These embodiments are of especially beneficial usefulness in the context of casing-running and casing-drilling operations, but their utility is not limited to those particular applications.

In a first embodiment, the floating sub tool comprises a housing having an upper end, a lower end, and a housing bore extending between an upper-end opening and a lower-end opening, and defining upper, middle, and lower intervals; an upper member having an upper end, a lower end, and an upper-member bore having a cylindrical lower interval. The upper member comprises:

an upper section having a cylindrical outer surface slidably disposed within the upper-end opening of the housing;

a middle section having a cylindrical outer surface in sealingly slidable engagement with the middle interval of the housing bore; and a lower section having a generally cylindrical outer surface with longitudinal splines.

The floating sub tool of the first embodiment also comprises a lower member having an upper end, a lower end, and a lower-member bore extending between the upper and lower ends of the lower member, and defining upper, middle, and lower intervals, with the upper interval of the lower-member bore having longitudinal splines matingly engageable with the splines on the lower section of the upper member. An upward-facing annular shoulder is formed at the juncture of the lower and middle intervals of the lower-member bore. Also included is an elongate cylindrical "stinger" having an upper end, a lower end, and a cylindrical outer surface, with the lower end of the stinger being sealingly mounted to the annular shoulder on the lower member such that the stinger is coaxial with the lower member.

An upper portion of the lower member is disposed within and mounted to the lower interval of the housing bore such that: the upper end of the stinger is slidably and sealingly disposed within the lower interval of the upper-member bore; the splines on the upper interval of the lower-member bore slidably engage the splines on the lower section of the upper member. As thus assembled, the sub tool defines:

an upper annular chamber defined by the upper interval of the housing bore, the middle section of the upper member; the upper section of the upper member, and the middle interval of the housing bore;

a middle annular chamber defined by the lower section of upper member, the middle section of the upper member, the upper end of the lower member, and the middle interval of the housing bore; and a lower annular chamber defined by the lower end of the upper member, the shoulder on the lower member, the middle interval of the lower-member bore, and the outer surface of the stinger;

with the volumes of the upper, middle, and lower annular chambers being variable according to the axial position of the upper member relative to the housing.

The upper annular chamber is in fluid communication with the exterior of the housing, and the middle and lower annular chambers are in fluid communication. The sub tool also includes regulator means for regulating pressure in the middle and lower annular chambers.

The lower member may be mounted to the housing by means of a threaded connection, but other alternative means of mounting the lower member to the housing may be used without departing from the scope of the present disclosure.

Fluid communication between the upper annular chamber and the exterior of the housing may be provided by any functionally effective means, such as but not limited to the provision of one or more flow channels extending through the housing wall and opening into the upper annular chamber, or via an interface between the upper section of the upper member and the upper-end opening of the housing (in which case the upper member will not be sealed in fluid-tight fashion relative to the upper-end opening).

Fluid communication between the middle and lower annular chambers may be provided by any functionally effective means, such as but not limited to configuring the splines on the upper interval of the lower-member bore and/or the splines on the lower section of the upper member to form axially-extending passages providing fluid communication between the middle and lower annular chambers. This functionality could also be provided by means of one or more channels drilled or otherwise formed in the lower member, extending between the upper end of the lower member and a lower region of the middle interval of the lower-member bore.

The regulator means may comprise a check valve extending through the housing wall into the middle annular chamber. However, other functionally effective regulator means could also be used for regulating pressure in the middle and lower annular chambers.

A second embodiment of a floating sub tool in accordance with the present disclosure substantially corresponds to the first embodiment described above, but with the addition of a fluid-tight seal where the upper section of the upper member passes through the upper-end opening of the housing, plus a passive compensator assembly mounted over the upper end of the housing. The passive compensator assembly comprises a preferably cylindrical sleeve having a sidewall, an upper end, and an open lower end. The upper end of the sleeve has a cap member with a central opening.

The sleeve is mounted over and around the housing such that the upper section of the upper member passes through the central opening in the sleeve's cap member, and the cap member is fixed to the upper end of the housing. The sidewall of the sleeve thus extends downward outside and around an upper region of the housing, forming an annular space between the sidewall and the housing. The lower end of this annular space is sealingly closed off by a suitable annular sleeve cap.

The upper annular chamber is in fluid communication with a lower region of the exterior annular space, and any functionally effective means may be provided for this purposes. For example, fluid communication between the upper annular chamber and a lower region of the exterior annular space may be provided by means of one or more suction tubes each connected at one end to a flow channel through the housing wall, and with the other end of each suction tube extending downward into a lower region of the exterior annular space. Alternatively, such fluid communication may be provided by means of one or more a Z-shaped channels formed into the housing wall.

BRIEF DESCRIPTION OF THE DRAWINGS

Embodiments will now be described with reference to the accompanying figures, in which numerical references denote like parts, and in which.

DETAILED DESCRIPTION OF PREFERRED EMBODIMENTS

Floating Sub Tool—First Embodiment

Figure 1:
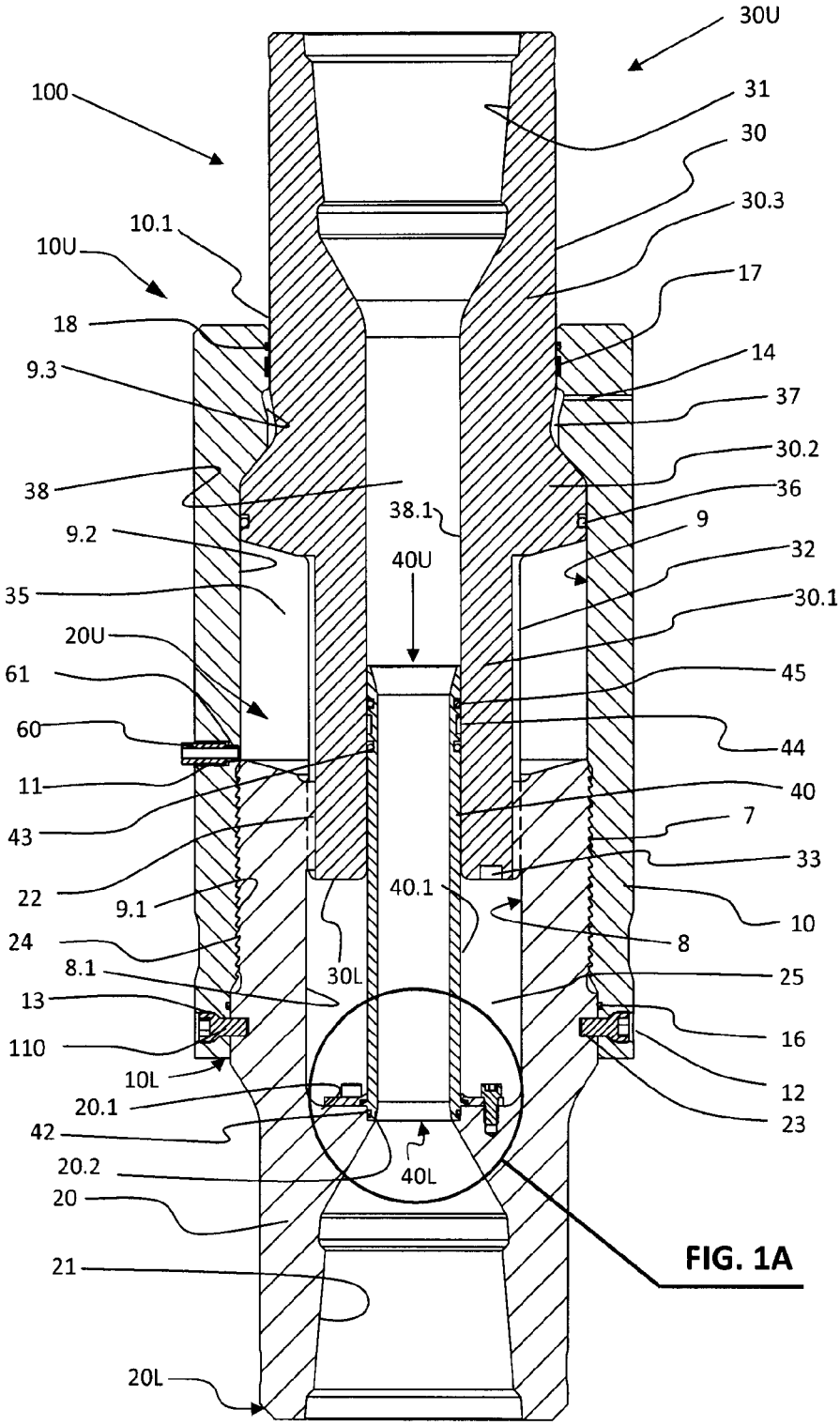
FIG. 1 is a longitudinal cross-section through a first embodiment of a floating sub tool in accordance with the present disclosure, shown in an extended position.
Figure 2:
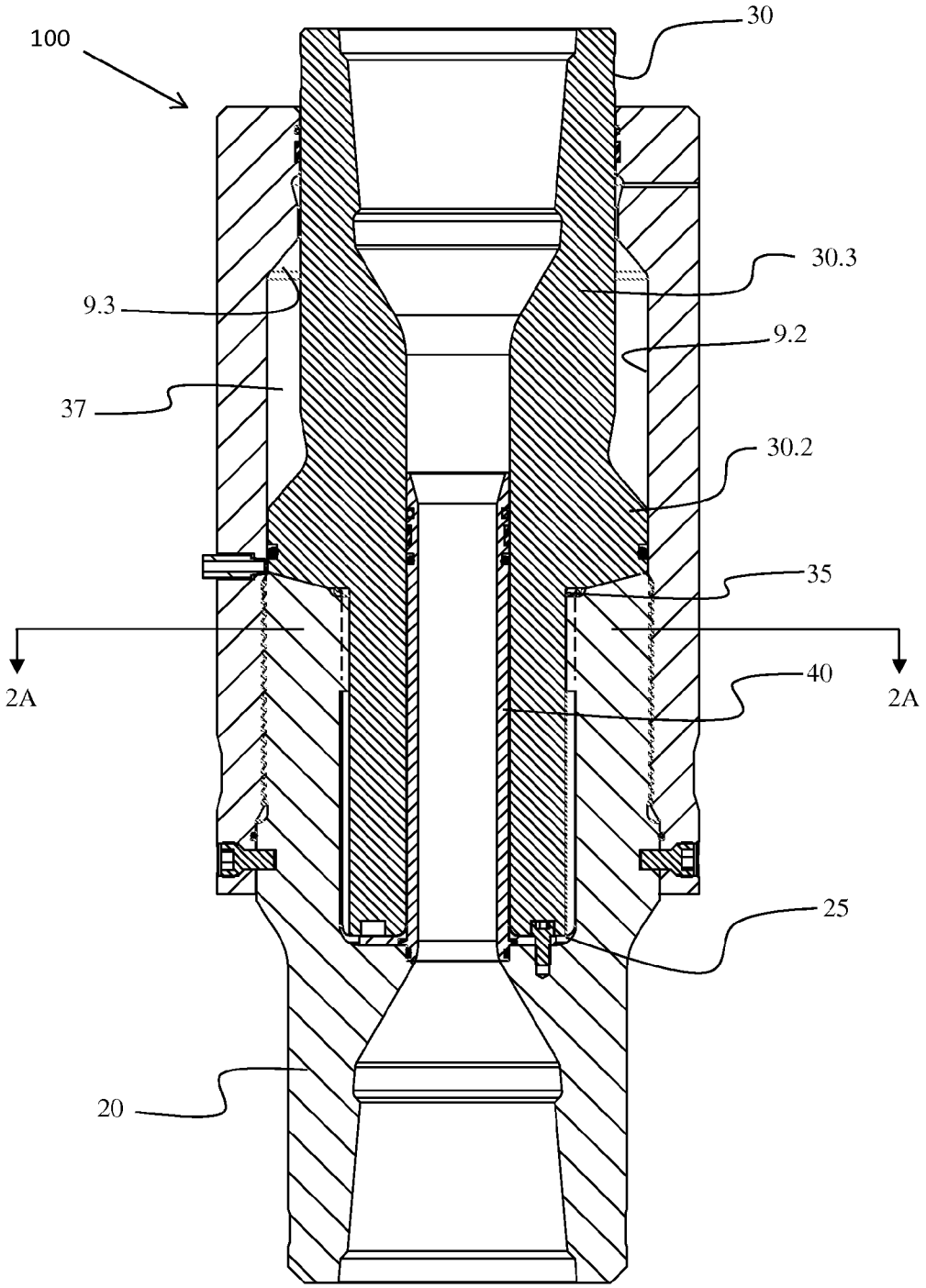
FIG. 2 is a longitudinal cross-section through the floating sub tool in FIG. 1, shown in a contracted position.

FIG. 1 is a longitudinal cross-section through a first embodiment of a floating sub tool ("FST") 100 in accordance with the present disclosure, and shown in an axially extended position. FIG. 2 is similar to FIG. 1, but shows FST 100 in an axially contracted (or retracted) position.

In the illustrated embodiment, FST 100 comprises a generally cylindrical housing 10, a generally cylindrical lower member 20, a generally cylindrical upper member 30, and a cylindrical stinger 40 connected to lower member 20 as will be described herein. (In the oil and gas industry, the term "stinger" is commonly used with reference to a cylindrical or tubular member associated with a downhole tool or component, but having a relatively small diameter compared to the associated tool or component.) Housing 10, lower member 20, upper member 30, and stinger 40 are each generally axi-symmetric.

Housing 10 has an upper end 10U, a lower end 10L, and a longitudinal through-bore 9 comprising a threaded cylindrical lower interval 9.1, an unthreaded cylindrical middle interval 9.2, and a contoured upper interval 9.3 terminating in a cylindrical opening 10.1 at upper end 10U.

Lower member 20 has an upper end 20U and a lower end 20L, plus a through-bore 8 extending between upper and lower ends 20U and 20L. Bore 8 comprises a splined section 22 adjacent upper end 20U and a generally cylindrical middle interval 8.1 extending between splined section 22 and an upward-facing annular shoulder 20.1 formed in a medial region of bore 8 between upper and lower ends 20U and 20L, with shoulder 20.1 defining a circular opening 20.2 having a diameter smaller than middle interval 8.1 of bore 8. At its upper end 20U, lower member 20 has an externally-threaded portion 7 for engagement with threaded lower interval of bore 9.1 of housing 10. At its lower end 20L, and below shoulder 20.1, lower member 20 has a threaded connection 21 for connection to a pipe section (or to an intervening component). Threaded connection 21 is illustrated as a box end, but could alternatively be a pin end. The thread type used for threaded connection 21 will be selected to provide sufficient torque and axial load capacity for anticipated service conditions.

Figure 1A:
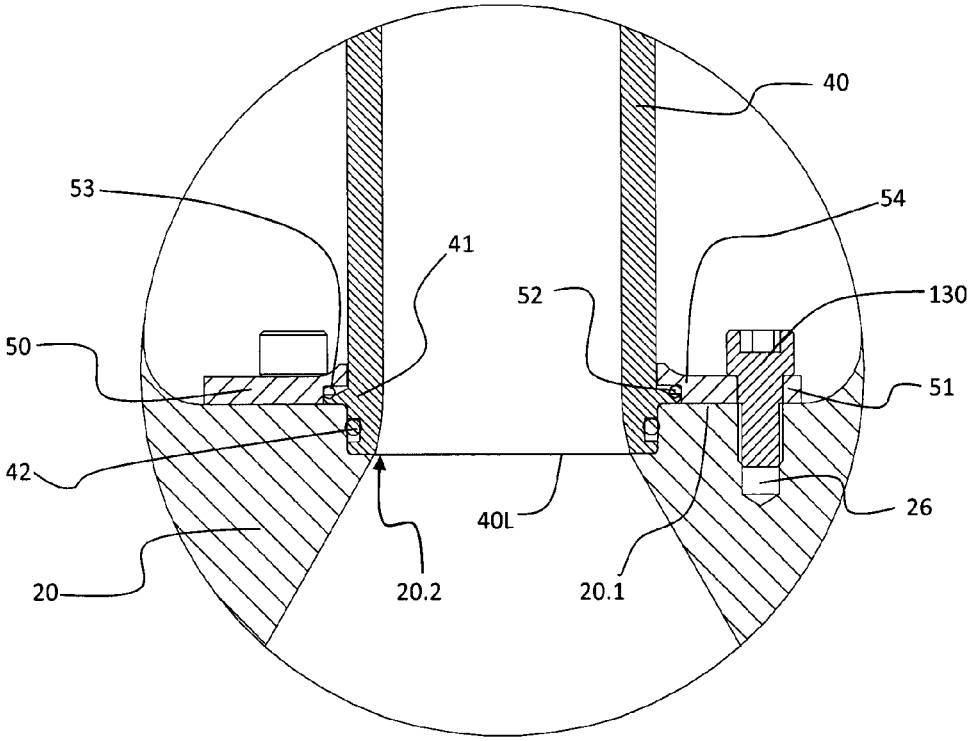
FIG. 1A is an enlarged detail of the resilient connection between the stinger and the lower member of the floating sub tool in FIG. 1.

As shown in the Figures, and in particular FIG. 1A, stinger 40 comprises a cylindrical tube having an upper end 40U, a lower end 40L, and a cylindrical outer surface 40.1, with both upper and lower ends 40U and 40L being open. Lower end 40L of stinger 40 is mounted to shoulder 20.1 on lower member 20, preferably in a sufficiently resilient manner to accommodate small angular deflections of stinger 40 relative to lower member 20 (such as may be induced by lateral forces and moments applied to FST 100 while in service), and to provide some tolerance for misalignment of one or more components of FST 100 during assembly.

In the illustrated embodiment, stinger 40 is formed with an outwardly-projecting circumferential lip 41 adjacent to but above lower end 40L of stinger 40, such that a portion of stinger 40 below lip 41 extends downward into opening 20.2 in lower member 20, with lip 41 resting on shoulder 20.1. A circumferential seal 42 is disposed in a suitable seal groove below lip 41 to seal stinger 40 relative to lower member 20. The seal groove can be formed in stinger 40 as shown in the Figures or, alternatively, in shoulder 20.1. Stinger 40 is secured to shoulder 20.1 by means of a clamp ring 50 placed over lip 41 and secured to shoulder 20.1 by suitable means (such as but not limited to cap screws 130 placed through holes 51 in clamp ring 50 and threaded into holes 26 in shoulder 20.1, as shown in FIG. 1A).

To facilitate mounting of clamp ring 50 over lip 41, clamp ring 50 may be formed with an annular recess 52 formed into its lower face to accommodate lip 41, as shown in FIG. 1A. Preferably, the vertical dimension of annular recess 52 will be larger than the thickness of lip 41, thus allowing a resilient element 53 (such as an O-ring) to be disposed within recess 52 above lip 41 as shown in FIG. 1A, thus allowing for some amount of angular deflection of stinger 40 relative to lower member 20. Persons skilled in the art will appreciate that the arrangement shown in FIG. 1A represents only one way of mounting stinger 40 to lower member 20, resiliently or otherwise, and the present disclosure is not intended to be limited by or to this particular arrangement. Various alternative means and methods of mounting stinger 40 may be devised in accordance with known techniques without departing from the scope of the present disclosure.

Referring again to FIG. 1, upper member 30 has an upper end 30U, a lower end 30L, and a through-bore 38, with a lower interval 38.1 of through-bore 38 configured to receive stinger 40 in a reasonably close-tolerance sliding fit. Upper member 30 comprises three main sections: a lower section (alternatively referred to as a mandrel section) 30.1 having a generally cylindrical outer surface formed with longitudinal splines 32 configured for mating engagement with splined section 22 of lower member 20; a middle section 30.2 having a cylindrical outer surface configured for a reasonably close-tolerance sliding fit with middle interval 9.2 of through-bore 9 of housing 10; and an upper section 30.3 having a cylindrical outer surface configured for a reasonably close-tolerance sliding fit within opening 10.1 in upper end 10U of housing 10.

As shown in FIG. 1, the cylindrical outer surface of middle section 30.2 carries an elastomeric or other suitable type of seal 36 to provide a fluid-tight seal against middle interval 9.2 of bore 9 of housing 10 as upper member 30 moves axially relative to housing 10. Preferably, a wear band 17 will be provided in association with opening 10.1 to limit frictional contact with upper section 30.3 during axial movement of upper member 30 relative to housing 10. An elastomeric or other suitable seal 18 is also provided in association with opening 10.1 to provide a fluid-tight seal against opening 10.1 as upper member 30 moves through opening 10.1. Upper section 30.3 is formed with a threaded connection 31 for connection to a top drive quill or to an intervening component. Threaded connection 31 is illustrated as a box end, but could alternatively be a pin end.

The assembly of FST 100 may be understood with reference to FIG. 1. Stinger 40 is mounted to lower member 20 as previously described. Upper member 30 is inserted into bore 9 of housing 10, with upper end 30U of upper member 30 extending upward through opening 10.1 at upper end 10U of housing 10. The subassembly of lower member 20 and stinger 40 is then installed by sliding upper end 40U of stinger 40 into lower interval 38.1 of through-bore 38 in upper member 30, engaging splined section 22 of lower member 20 with splines 32 of mandrel section 30.1 of upper member 30, and securely connecting lower member 20 to housing 10 by rotating housing 10 (and upper member 30 along with it) such that threaded portion 7 of lower member 20 engages threaded lower bore 9.1 of housing 10 (or, in alternative embodiments, by other functionally effective connection means). In the embodiment shown in FIG. 1, an upper seal 45 and a lower seal 43 are provided near upper end 40U of stinger 40 for sealing against lower interval 38.1 of through-bore 38 as stinger 40 moves axially within through-bore 38, and a wear band 44 is provided in association with stinger 40, preferably between seals 43 and 45 as shown. Strictly speaking, only one seal is required at this location, for the primary purpose of preventing the entry of wellbore fluids into FST 100, but it may be desirable to use two seals as shown to provide seal redundancy. In such cases, the two seals (43 and 45 in the illustrated embodiment) will preferably be uni-directional seals, such that only one of the seals will be effective depending on which direction stinger 40 is moving relative to upper member 30; this is to prevent the undesirable build-up of pressure between the two seals.

When the main components of FST 100 have been thus assembled, relative rotation between housing 10 and lower member 20 may be prevented by suitable means such as, in the illustrated embodiments, in the form of threaded shear lugs 110 inserted through holes 13 in the wall of housing 10 and into threaded holes 23 in lower member 20. However, this arrangement is by way of non-limiting example only. Persons skilled in the art will appreciate that various alternative means can be devised for preventing relative rotation between housing 10 and lower member 20, and such alternative means are intended to come within the scope of the present disclosure. It is to be understood, however, that although it may be generally desirable for lower member 20 to be made non-rotatable relative to housing 10 (perhaps particularly in embodiments as illustrated, wherein lower member 20 is mounted to housing 10 by means of a threaded connection that might be susceptible to loosening), this is not essential, as a certain degree of rotatability of lower member 20 relative to housing 10 will not affect or impair torque transfer between upper and lower members 30 and 20.

Upper member 30 is axially slidable relative to housing 10, lower member 20, and stinger 40 by virtue of the splined sliding engagement of splined section 22 of lower member 20 with splines 32 of mandrel section 30.1 of upper member 30, and the sliding engagement of stinger 40 within lower interval 38.1 of through-bore 38 of upper member 30. Torque loadings applied to upper member 20 are transferred to lower member 30 by the splined connection, and vice versa. Accordingly, the number and configuration of the splines, as well as the minimum axial length of spline engagement, will be selected as required to provide FST 100 with a desired torsional load capacity.

The axial stroke range of upper member 30 is defined or determined by the axial distance between contoured upper interval 9.3 of bore 9 in housing 10 and upper end 20U of lower member 20, and also by the axial dimension of middle section 30.2 of upper member 30. FIG. 1 illustrates FST 100 in an extended position, with upper member 30 at the uppermost end of its axial stroke range. FIG. 2 shows FST 100 in a retracted (or contracted) position, with upper member 30 at the lowermost end of its axial stroke range.

As may be seen in FIGS. 1 and 2, FST 100 defines three annular chambers:

- a lower annular chamber 25 bounded by: lower end 30L of upper member 30; shoulder 20.1 on lower member 20; middle interval 8.1 of through-bore 8 of lower member 20; and outer surface 40.1 of stinger 40;
- a middle annular chamber 35 bounded by: an upper region of mandrel section 30.1 of upper member 30; a lower region of middle section 30.2 of upper member 30; upper end 20U of lower member 20; and a portion of middle interval 9.2 of bore 9 in housing 10; and
- an upper annular chamber 37 bounded by: a lower portion of upper interval 9.3 of bore 9 in housing 10; middle section 30.2 of upper member 30; a lower region of upper section 30.3 of upper member 30; and an upper region of middle interval 9.2 of bore 9 in housing 10.

Figure 2A:
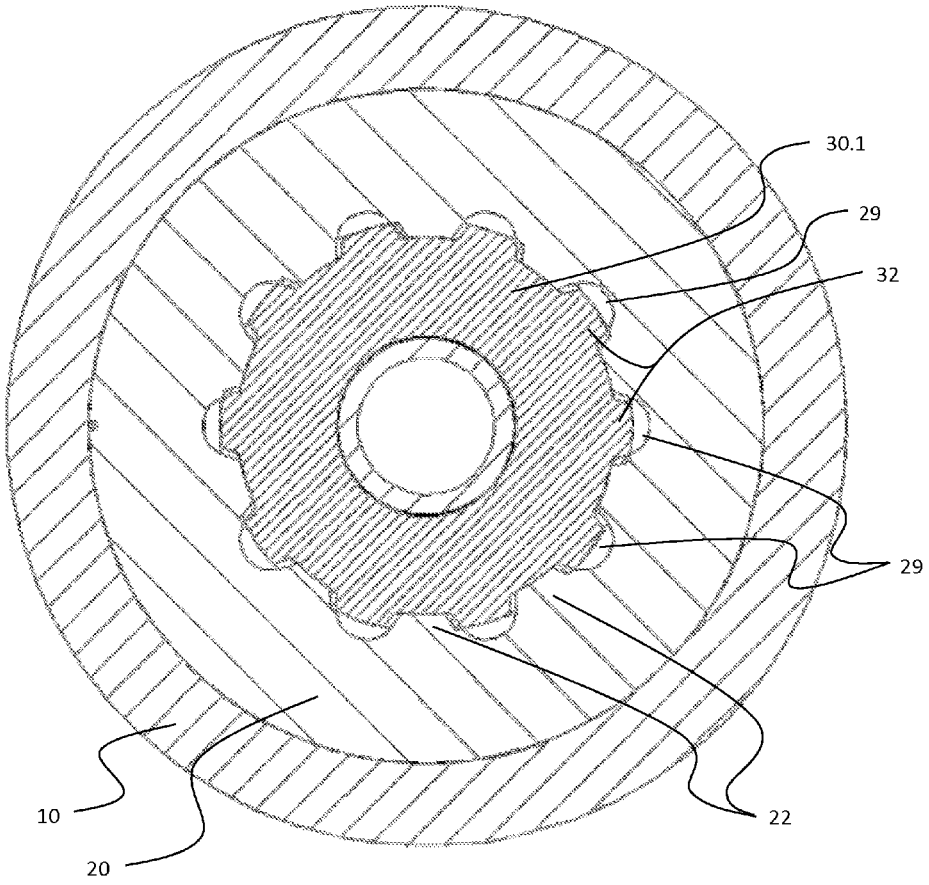
FIG. 2A is a transverse cross-section through the floating sub tool shown in FIG. 2.

The volumes and vertical heights of lower annular chamber 25 and middle annular chamber 35 will decrease as upper member 30 moves downward into housing 10 (i.e., as upper member 30 moves from an extended position as in FIG. 1 toward a retracted position as in FIG. 2), while the volume and vertical height of upper annular chamber 37 will increase; and vice versa. Splines 22 on lower member 20 and splines 32 on mandrel section 30.1 of upper member 30 are configured such that when they are engaged as shown in FIGS. 1 and 2, and as shown in greater detail in FIG. 2A, they will form axially-extending passages 29 whereby lower annual chamber 25 and middle annular chamber 35 will be in fluid communication regardless of the axial position of upper member 30 relative to housing 10, and thereby facilitating pressure equalization as between lower annual chamber 25 and middle annular chamber 35.

Figure 2B:
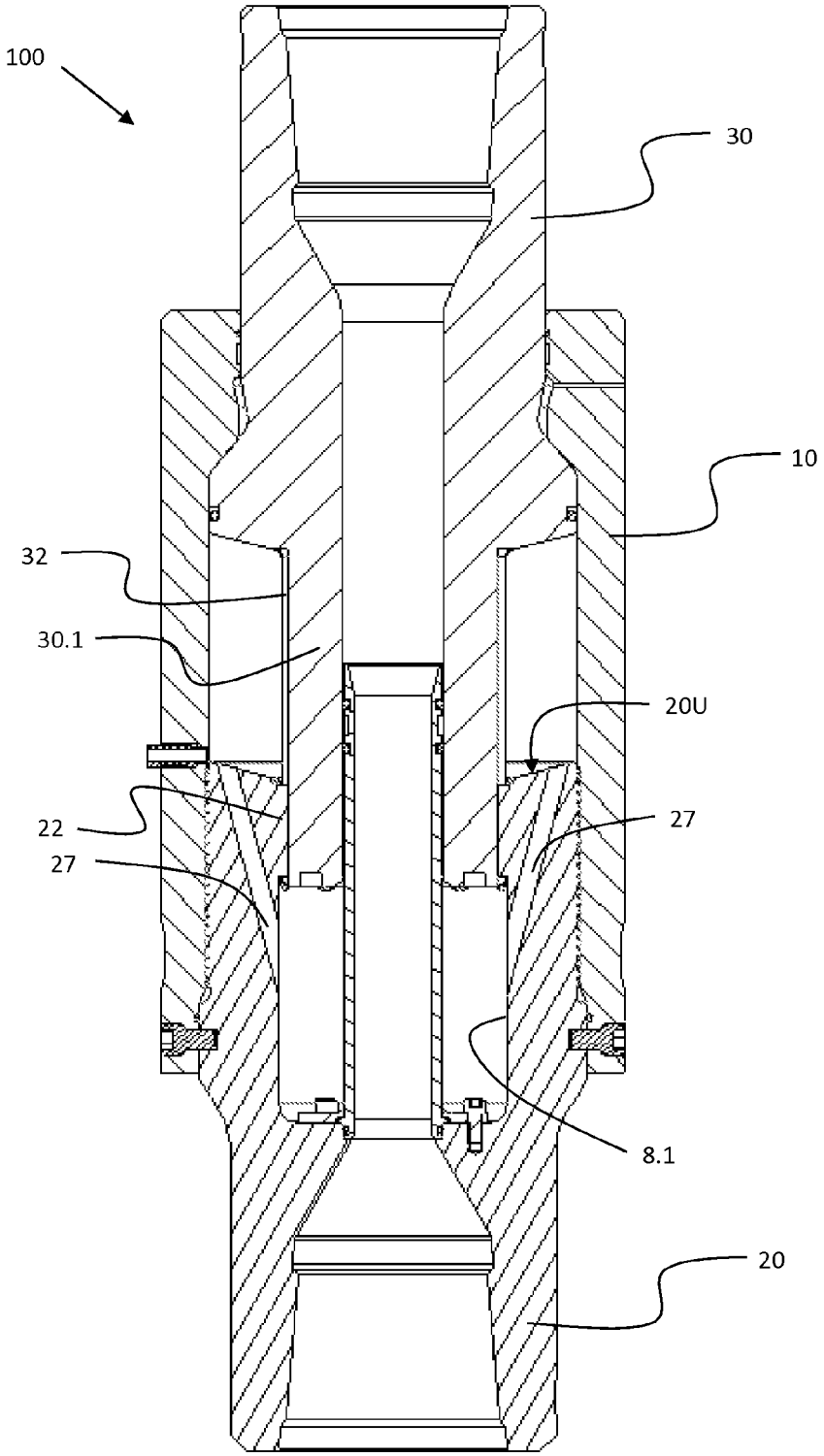
FIG. 2B is a longitudinal cross-section through a variant of the floating sub tool shown in FIGS. 1 and 2.

Persons skilled in the art will appreciate that alternative means for providing fluid communication between annular chambers 25 and 35 may be readily devised, and the present disclosure is not restricted to the provision of axially-extending passages in the splines for that purpose. For example, and as shown in FIG. 2B, fluid communication between annular chambers 25 and 35 could alternatively be provided by providing one or more channels 27 drilled obliquely into upper end 20U of lower member 20 and exiting through a lower region of middle interval 8.1 of lower-member bore 8.

Because they are in fluid communication as noted above, lower annular chamber 25 and middle annular chamber 35 effectively define a sealed volume enclosed by seals 16, 36, 42, and 43. Communication of fluids between lower annular chamber 25 and through-bore 38 is prevented by seals 45 and 42 (and by seal 43 in variants of the illustrated embodiment in which seals both seals 43 and 45 provide sealing redundancy as discussed previously herein).

A regulator/check valve 60 is provided to control the pressure in annular chambers 35 and 25. In the illustrated embodiment, regulator/check valve 60 extends through the wall of housing 10 and into middle interval 9.2 of bore 9 of housing 10, immediately above threaded lower interval 9.1 of bore 9. Accordingly, seal 36 will not interfere with regulator/check valve 60 when upper member 30 is fully retracted into housing 10. However, it is not essential for regulator/check valve 60 (or a functionally equivalent device) to be in the specific location shown in the Figures, and persons skilled in the art will readily appreciate that other effective means of providing pressure communication between annular chambers 35 and 25 may be readily devised without inventive effort. To provide one non-limiting example of this, regulator/check valve 60 could alternatively pass through the wall of housing 10 within threaded lower interval 9.1 of bore 9, and forming a groove into or radially inward of the threads on externally-threaded portion 7 of lower member 20 (or, alternatively, a longitudinal bore extending downward through splined section 22 and central section 8.1 of lower member 20) to provide fluid communication between annular chamber 35 and regulator/check valve 60.

In the illustrated embodiment, regulator/check valve 60 is securely connected and sealed to housing 10 through hole 11 by means of tapered threads 61. However, the present disclosure is not limited to this particular means of sealingly securing regulator/check valve 60 to housing 10.

The characteristics of regulator/check valve 60 are selected to provide a desired pressure for compressive load compensation, or a desired vacuum to provide tensile load compensation. Alternatively, in lieu of regulator/check valve 60, a plug of suitable type could be used to prevent the flow of fluid in or out of annular chambers 35 and 25. The magnitude of axial load compensation will be a function (positive or negative, as the case may be) of the pressure within annular chambers 35 and 25 and the cross-sectional area over which this pressure acts.

Referring to FIG. 1, upper annular chamber 37 is defined by seal 18 at opening 10.1 in housing 10, and seal 36 on middle interval 9.2 of bore 9 of housing 10. One or more flow channels 14 are provided through the wall of housing 10 below seal 18 to allow fluid to enter into and escape from upper annular chamber 37 as upper member 30 strokes axially relative to housing 10, lower connection member 20, and stinger 40. For a given stroke rate, the pressure load generated within upper annular chamber 37 will be dependent on the pressure drop across flow channels 14, which pressure drop will be a function of the diameter and number of flow channels 14 provided.

In the embodiment shown in FIGS. 1, 1A, and 2, it is not essential for seal 18 to provide a fluid-tight seal, given that upper annular chamber 37 is in fluid communication with the exterior of FST 100 in any event, via flow channels 14 through the wall of housing 10. Accordingly, in this embodiment seal 18 could be provided in the form of a non-fluid-tight wiper seal.

It should also be noted that flow channels 14 as illustrated are only one means for providing pressure relief from upper annular chamber 37, and other means of providing pressure relief that are within the knowledge and capability of persons skilled in the art are intended be encompassed by the scope of the present disclosure. To provide only one non-limiting example, flow channels 14 could be eliminated in embodiments in which a fluid-tight seal is not provided in association with opening 10.1 of housing 10. In such alternative embodiments, upper annular chamber would be in fluid communication with the exterior of FST 100 through the unsealed opening 10.1 (such as, for example, when seal 18 is provided in the form of a wiper as previously discussed).

As shown in FIGS. 1 and 2, lower end 30L of upper member 30 may optionally be formed with recesses 33 sized and spaced to receive the heads of fasteners 130 used to mount stinger clamp ring 50 to shoulder 20.1 of lower member 20 when upper member 30 is fully retracted into bore 8 of lower member 20.

Housing 10, lower member 20, upper member 30, and stinger 40 are shown and described herein as being of generally cylindrical configuration, and such configuration will typically be most convenient for purposes of fabrication and operation. However, the various components of floating sub tools in accordance with the present disclosure are not intended to be limited or restricted to such configuration. Persons skilled in the art will appreciate that variants are possible in which one or more components of the floating sub tool are not of generally cylindrical configuration, but the variants are nonetheless operable in essentially the same manner as described herein. All such variants are intended to come within the scope of the present disclosure.

Floating Sub Tool with Passive Compensator

Figure 3:
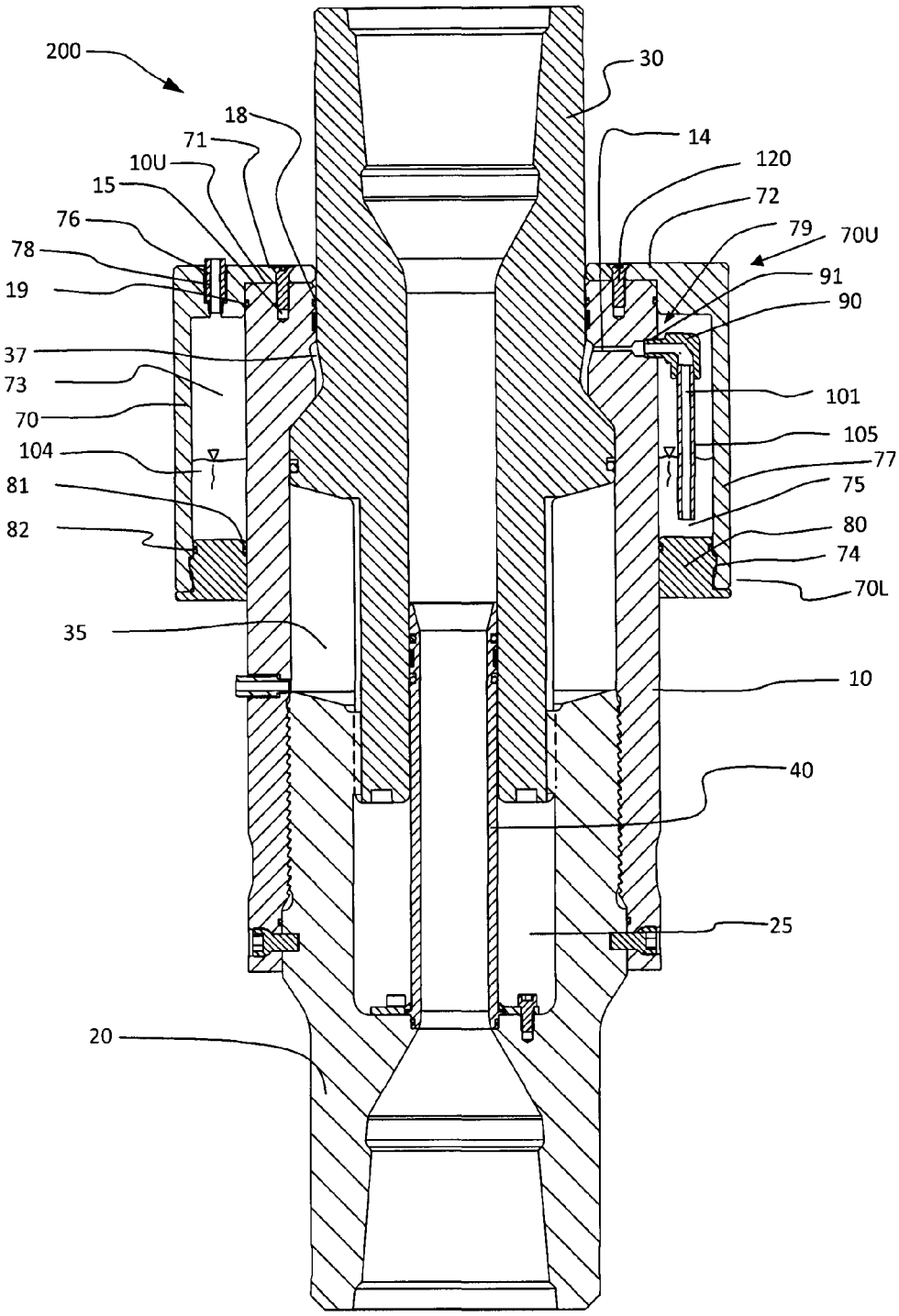
FIG. 3 is a longitudinal cross-section through a second embodiment of a floating sub tool in accordance with the present disclosure.

FIG. 3 illustrates a floating sub tool 200 in accordance with a second embodiment. Floating sub tool 200 comprises a floating sub tool substantially corresponding to floating sub tool (FST) 100 previously described with reference to FIGS. 1, 1A, and 2, plus additional components and features as described herein and illustrated in FIG. 3. To more distinctly differentiate it from FST 100, this second embodiment may be alternatively referred to as a floating sub tool with passive compensator, abbreviated as FST-PC 200. The following description of FST-PC 200 uses reference numbers corresponding to those previously used with respect to FST 100, to the extent that FST-PC 200 has components in common therewith.

As shown in FIG. 3, a sleeve 70 (preferably but not necessarily generally cylindrical in configuration) is mounted externally to and concentrically with housing 10. Sleeve 70 has an upper end 70U and a lower end 70L, with a cap member 72 extending across upper end 70U and having an opening 72.1 through which an upper portion of upper member 30 can pass as upper member 30 moves through its axial stroke relative to housing 10. Sleeve 70 has a cylindrical sidewall 77 larger in diameter than housing 10, such that when sleeve 70 is secured to and over upper end 10U of housing 10 (such as by means of cap screws 120 placed through holes 71 in cap member 72 and threaded into holes 15 in upper end 10U of housing 10), an annular space 73 is formed between cylindrical wall 77 and the adjacent perimeter surface of housing 10.

As shown in FIG. 3, annular space 73 is sealingly closed off adjacent to lower end 70L of sleeve 70 by means of an annular sleeve cap 80 of any functionally suitable type. Sleeve cap 80 may be connected to sidewall 77 by means of a threaded connection 74 as shown, but other means of securing sleeve cap 80 to sidewall 77 and/or housing 10 may be devised without departing from the scope of the present disclosure. Suitable lower seals 81 and 82 are provided to seal sleeve cap 80 against housing 10 and sleeve sidewall 77 respectively, and a suitable upper seal 19 is provided to seal an upper region of sleeve 70 relative to housing 10, thereby making annular space 73 effectively fluid-tight.

The one or more flow channels 14 provided in housing 10 allow for fluid communication between upper annular chamber 37 and annular space 73. At each flow channel 14, a suction tube 105 connects to and sealingly engages an elbow fitting 90 which is connected to and sealingly engages housing 10 at flow channel 14. Each suction tube 105 and its associated elbow fitting 90 and flow channel 14 combine to form a continuous flow path 101 allowing fluid transfer from a lower region of annular space 73 into upper annular chamber 37; in combination, these features may be considered as forming a fluid system generally denoted by reference number 79. In alternative embodiments, suction tube 105 may integrally incorporate an elbow fitting, rather than being connected to a separate elbow fitting 90 as shown in FIG. 3.

It should be noted that for purposes of FST 200 and alternative embodiments thereof, the upper end of upper annular chamber 37 must be sealed relative to upper section 30.3 of upper member 30, because unlike in the embodiment shown in FIGS. 1, 1A, and 2 (i.e., FST 100), upper annular chamber 37 in FST 200 will be pressurized and not vented to the outside. Accordingly, seal 18 for purposes of FST 200 will be a fluid-tight seal.

Movement of upper member 30 relative to housing 10 causing axial contraction of FST-PC 200 will increase the volume of upper annular chamber 37, resulting in a pressure drop in upper annular chamber 37 relative to annular space 73, which will equalize when fluid from annular space 73 is drawn into upper annular chamber 37 through flow path 101, due to negative pressure induced in annular space 73. The system is damped by resistance to this pressure equalization due to frictional flow loss in flow path 101.

Conversely, movement of upper member 30 relative to housing 10 resulting in axial expansion of FST-PC 200 will decrease the volume of upper annular chamber 37, thus causing the pressure in upper annular chamber 37 to increase relative to the pressure in annular space 73. Similar to the case of axial contraction, frictional flow losses in flow path 101 result in some resistance to this expansive axial movement. It is to be understood that the number and diameters of the elements constituting flow path 101, as well as the fluid characteristics in fluid system 79, can be selected to provide desired flow resistance and damping characteristics to suit particular operational conditions.

In the illustrated embodiment, annular space 73 is shown partially filled with a volume of a liquid 75 somewhat greater than the volume of upper annular chamber 37 when FST-PC 200 is fully contracted. Cap member 72 of sleeve 70 is provided with a fluid fill port 75 for purposes of introducing liquid 75 into annular space 73, plus a fluid fill valve 76 located in and sealingly engaging fluid fill port 75. In the illustrated embodiment, fluid fill valve 76 is shown as a check valve, such that a pressurized gas can be introduced into fluid system 79. It is to be understood that the gas pressure and volume of annular space 73, in conjunction with the fluid level and the minimum volume of upper annular chamber 37, can be selected to provide a desired spring force and spring rate. As such, fluid system 79 will be biased to the maximum volume of upper annular chamber 37, and consequently FST-PC 200 will be biased by this gas spring to the fully-contracted position. The gas pressure within annular space 73 can be selected such that FST-PC 200 begins to stroke at an axial force equal to or close to the load suspended by the tool, thus acting as a passive load compensator.

Load compensation and damping as a result of pressure in fluid system 79 can act independently of or in conjunction with load compensation provided by negative pressure (vacuum) in middle annular chamber 35.

Figure 3A:
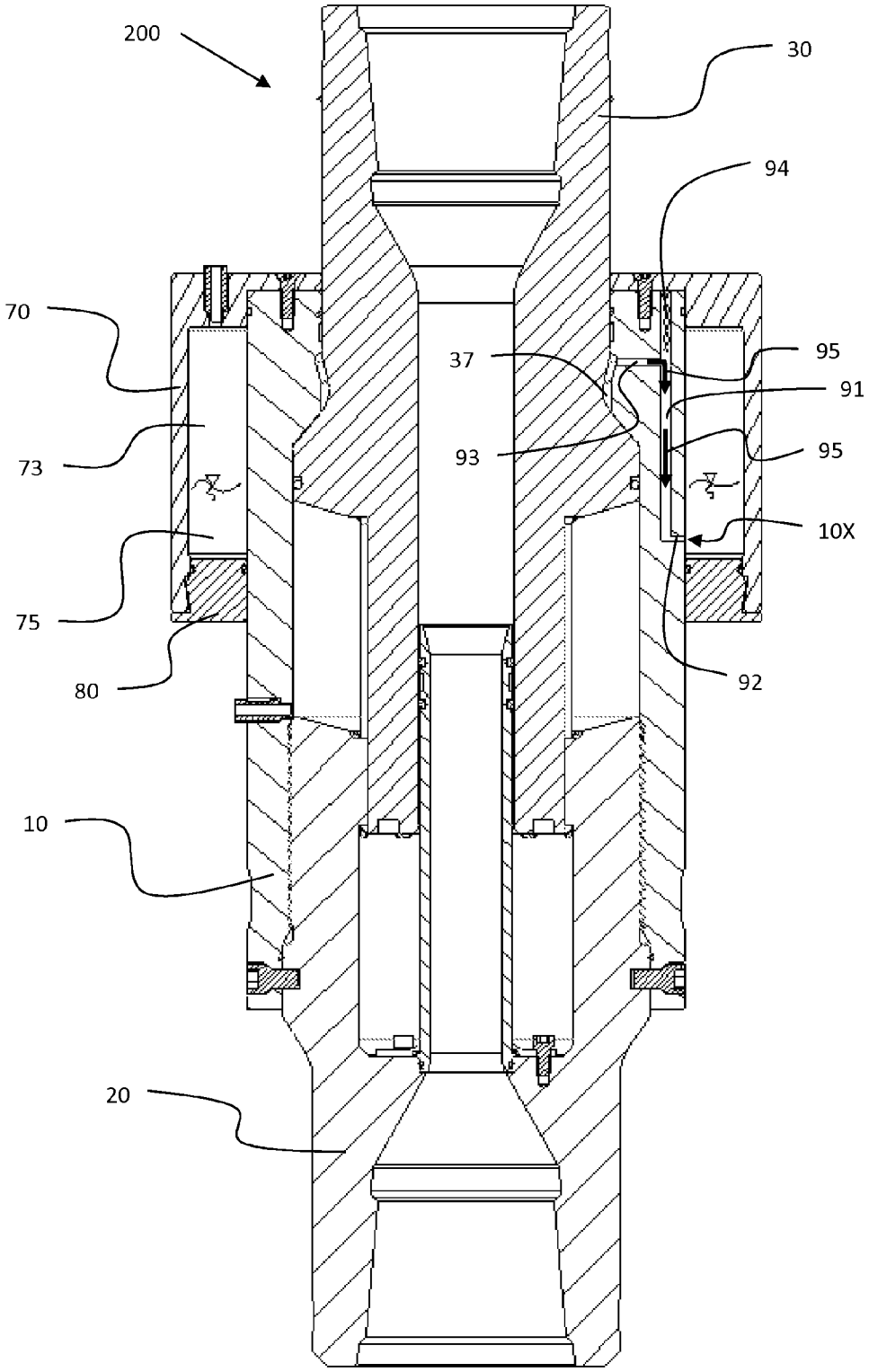
FIG. 3A is a longitudinal cross-section through a variant of the floating sub tool shown in FIG. 3.

It should be noted that it is not essential for FST 200 to incorporate a suction tube 105 as shown in FIG. 3, as suction tube 105 is only one possible means for establishing a continuous flow path allowing fluid transfer from a lower region of annular space 73 into upper annular chamber 37. For example, and as shown in FIG. 3A, such a continuous flow path (denoted by flow arrows 95 in FIG. 3A) could be provided by boring a longitudinal hole 91 downward into the wall of housing 10 to a point 10X adjacent a lower region of annular space 73, then boring a lower radial hole 92 inward into the wall of housing 10 to intercept the bottom of longitudinal hole 91, and boring an upper radial hole 93 outward into the wall of housing 10 to intercept longitudinal hole 91 (and then plugging longitudinal hole 91 above upper radial hole 93 (as indicated by the cross-hatching denoted by reference number 94 in FIG. 3A), thus creating a Z-shaped continuous flow path.

It will be readily appreciated by those skilled in the art that various modifications of embodiments in accordance with the present disclosure may be devised without departing from the scope and teaching of the disclosure, including modifications which may use equivalent structures or materials hereafter conceived or developed. It is to be especially understood that the present disclosure is not intended to be limited to any particular described or illustrated embodiment, and that the substitution of a variant of a claimed element or feature, without resulting in any substantial change in operation, will not constitute a departure from the scope of the disclosure or claimed embodiments. It is also to be appreciated that the different teachings of the embodiments described and discussed herein may be employed separately or in any suitable combination to produce desired results.

In this patent document, any form of the word "comprise" is to be understood in its non-limiting sense to mean that any item following such word is included, but items not specifically mentioned are not excluded. A reference to an element by the indefinite article "a" does not exclude the possibility that more than one such element is present, unless the context clearly requires that there be one and only one such element.

Any use herein of any form of the terms "connect", "engage", "mount", "couple", "attach", or other terms describing an interaction between elements is not meant to limit the interaction to direct interaction between the subject elements, and may also include indirect interaction between the elements such as through secondary or intermediary structure. Relational terms such as "parallel", "perpendicular", "coincident", "coaxial", "intersecting", and "equidistant" are not intended to denote or require absolute mathematical or geometrical precision. Accordingly, such terms are to be understood as denoting or requiring substantial precision only (e.g., "substantially parallel") unless the context clearly requires otherwise. As used in this document, the terms "typical" and "typically" are used in the sense of representative or common usage or practice, and are not to be understood as implying essentiality or invariability. References to "fluids" are to be understood as encompassing either liquids or gases, unless the context clearly requires such references to pertain to liquids only or to gases only.

In this patent document, certain elements and features of the disclosed sub tool are described using relational adjectives such as "upper" and "lower". Such terms are used to establish a convenient frame of reference to facilitate explanation and enhance understanding spatial relationships and relative locations of the various elements and features. The use of such terms is not to be interpreted as implying that they will be technically applicable in all practical applications and usages of sub tools in accordance with the present disclosure, or that such sub tools must be used in spatial orientations that are strictly consistent with the adjectival terms used herein. For example, sub tools in accordance with the present disclosure could conceivably be used in orientations that are oblique or inverted as compared to the orientations described herein and illustrated in the accompanying Figures.

The embodiments in which an exclusive property or privilege is claimed are defined as follows:

1. A sub tool for use with a top drive of a drilling rig, said sub tool comprising:

(a) a housing having an upper end, a lower end, and a housing bore extending between an upper-end opening and a lower-end opening, and defining upper, middle, and lower intervals;

(b) an upper member having an upper end, a lower end, and an upper-member bore having a cylindrical lower interval, and said upper member comprising:

b.1 an upper section having a cylindrical outer surface slidably disposed within the upper-end opening of the housing;

b.2 a middle section having a cylindrical outer surface in sealingly slidable engagement with the middle interval of the housing bore; and b.3 a lower section having a generally cylindrical outer surface with longitudinal splines;

(c) a lower member having an upper end, a lower end, and a lower-member bore extending between the upper and lower ends of the lower member, and defining upper, middle, and lower intervals, with the upper interval of the lower-member bore having longitudinal splines matingly engageable with the splines on the lower section of the upper member; and wherein an upward-facing annular shoulder is formed at the juncture of the lower and middle intervals of the lower-member bore; and (d) an elongate stinger having an upper end, a lower end, and a cylindrical outer surface, said lower end of the stinger being sealingly and coaxially mounted to the annular shoulder on the lower member;

wherein:

(e) an upper portion of the lower member is disposed within and fixedly mounted to the lower interval of the housing bore such that:

e.1 the upper end of the stinger is slidably and sealingly disposed within the lower interval of the upper-member bore; and e.2 the splines on the upper interval of the lower-member bore slidably engage the splines on the lower section of the upper member; and (f) the sub tool has:

f.1 an upper annular chamber defined by the upper interval of the housing bore, the middle section of the upper member; the upper section of the upper member, and the middle interval of the housing bore;

f.2 a middle annular chamber defined by the lower section of upper member, the middle section of the upper member, the upper end of the lower member, and the middle interval of the housing bore; and f.3 a lower annular chamber defined by the lower end of the upper member, the shoulder on the lower member, the middle interval of the lower-member bore, and the outer surface of the stinger;

with the volumes of the upper, middle, and lower annular chambers being variable according to the axial position of the upper member;

(g) the upper annular chamber is in fluid communication with the exterior of the housing;

(h) the middle and lower annular chambers are in fluid communication; and (i) the sub tool includes regulator means for regulating pressure in the middle and lower annular chambers.

2. A sub tool as in claim 1 wherein the lower member is mounted to the housing by means of a threaded connection.

3. A sub tool as in claim 1 wherein the upper annular chamber is in fluid communication with the exterior of the housing by means of at least one flow channel extending through the housing wall and opening into the upper annular chamber.

4. A sub tool as in claim 1 wherein the upper annular chamber is in fluid communication with the exterior of the housing via an interface between the upper section of the upper member and the upper-end opening of the housing.

5. A sub tool as in claim 1 wherein the middle and lower annular chambers are in fluid communication via axially-extending passages formed by mating pairs of splines on the upper and lower members.

6. A sub tool as in claim 1 wherein the middle and lower annular chambers are in fluid communication via one or more channels extending between the upper end of the lower member and a lower region of the middle interval of the lower-member bore.

7. A sub tool as in claim 1 wherein the regulator means comprises a check valve extending through the housing wall into the middle annular chamber.

8. A sub tool as in claim 1, further comprising:

(a) a fluid-tight seal associated with the upper-end opening of the housing, for providing a fluid-tight seal against the upper section of the upper member; and (b) a sleeve having a sidewall, an upper end, and an open lower end, said upper end having a cap member with an opening, wherein the sleeve is mounted to the housing with the cap member fixed to the upper end of the housing, with the sidewall extending downward outside the housing, and with an annular sleeve cap sealing the perimeter gap thus formed between the lower end of the sleeve and the outer surface of the housing, thus forming an annular space exterior to the housing, and bounded by the cap member, the sidewall of the sleeve, the sleeve cap, and the outer surface of the housing;

wherein the upper annular chamber is in fluid communication with a lower region of the exterior annular space.

9. A sub tool as in claim 8 wherein fluid communication between the upper annular chamber and a lower region of the exterior annular space is provided by means of one or more suction tubes each connected at one end to a flow channel through the housing wall, and with the other end of each suction tube extending downward into a lower region of the exterior annular space.

10. A sub tool as in claim 8 wherein fluid communication between the upper annular chamber and a lower region of the exterior annular space is provided by means of one or more Z-shaped channels formed into the housing wall.

* * * * *